United States Patent [19]

Müller et al.

[11] 3,957,088

[45] May 18, 1976

[54] METHOD AND LOOM FOR WEAVING A FABRIC

[75] Inventors: Jakob Müller; Erich Essig, both of Aargau, Switzerland

[73] Assignee: said Jakob Müller, Aargau, Switzerland, by said Erich Essig

[22] Filed: July 23, 1973

[21] Appl. No.: 381,492

Related U.S. Application Data

[63] Continuation-in-part of Ser. No. 170,793, Aug. 11, 1971, abandoned.

[30] Foreign Application Priority Data

Aug. 12, 1970 Germany ..... 2040050

[52] U.S. Cl. ..... 139/117

[51] Int. Cl. ..... D03d 47/00

[58] Field of Search ..... 139/11, 116, 117, 118, 139/48, 49, 124

[56] References Cited

UNITED STATES PATENTS

| | | | |
|---|---|---|---|
| 1,728,357 | 9/1929 | Muheim | 139/117 |
| 2,906,296 | 9/1959 | Ancet et al. | 139/124 |
| 3,061,907 | 11/1962 | Nicholl | 139/116 |
| 3,692,068 | 9/1972 | Auer et al. | 139/116 |

FOREIGN PATENTS OR APPLICATIONS

| | | | |
|---|---|---|---|
| 2,040,050 | 2/1972 | Germany | |
| 2,017,446 | 4/1970 | Germany | 139/117 |

*Primary Examiner*—Henry S. Jaudon
*Attorney, Agent, or Firm*—Michael S. Striker

[57] ABSTRACT

To insert an effect thread into a fabric being woven a warp is opened and an effect thread is inserted from one side into the open warp. It is then engaged from the open side of the warp and retained until such time as it can no longer be withdrawn from the warp due to its own tension.

11 Claims, 12 Drawing Figures

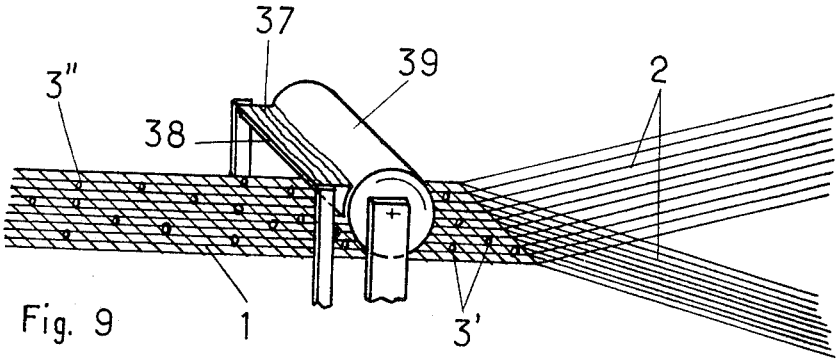
Fig. 9
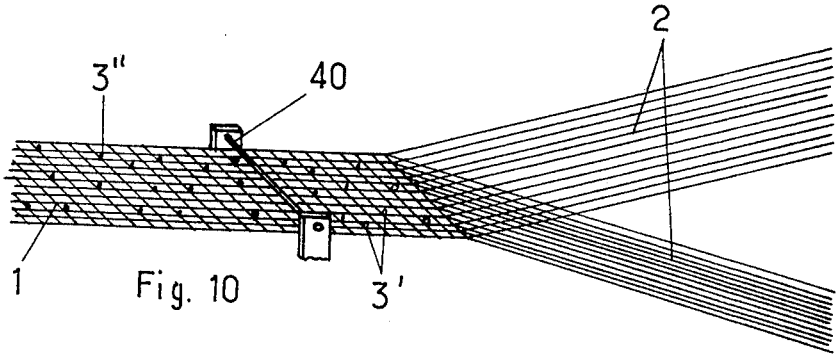
Fig. 10
Fig. 7
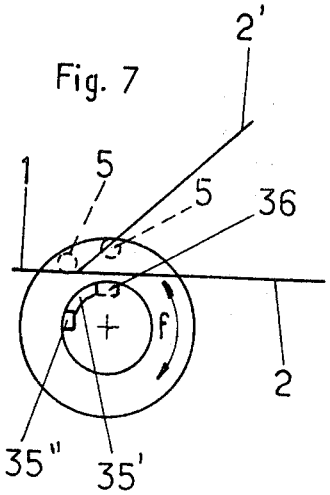
Fig. 8
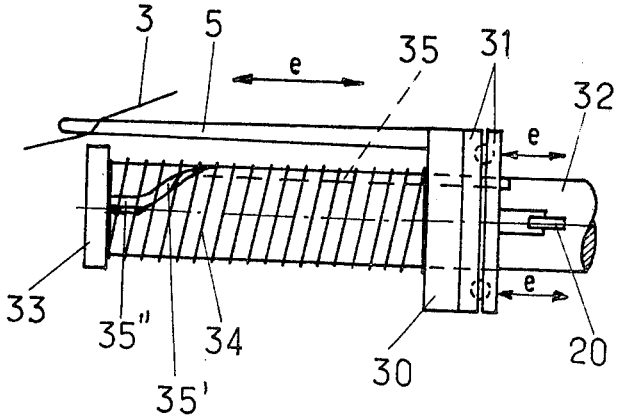

METHOD AND LOOM FOR WEAVING A FABRIC

BACKGROUND OF THE INVENTION

This is a continuation-in-part of our earlier application Ser. No. 170,793, filed on Aug. 11, 1971 and now abandoned.

The present invention relates generally to the weaving of fabrics, and more particularly to a novel weaving method and to an apparatus or loom for carrying out the method.

The invention is particularly concerned with the insertion of effect threads into fabrics, that is threads which are to produce on or in the fabric a particular visual and/or textural effect. When in shuttle looms effect weft threads are to be inserted into fabrics, then this is generally carried out by means of one or more shuttles which insert the effect threads. The width over which the effect thread is visible on the fabric and anchored therein, is determined by the raising or lowering of a predetermined number of warp threads in the warp. In needle looms this is somewhat different. In this type of loom it is not only the basic weft but also the effect thread or threads which are laterally inserted into the fabric with a usually needle-shaped inserting device. In this type of loom the starting point of the elongation over which the effect thread or threads can be seen in the fabric, can be determined at the side at which the effect thread is inserted into the warp by appropriately raising or lowering some of the warp threads. At the opposite side, however, the effect thread must be anchored in different manner which heretofore has been effected either by inserting the effect thread to the selvedge and retaining it with the aid of a retaining needle by appropriate formation of loops or the like in which case that portion of the effect thread which is not to be visible at the surface of the fabric remains below the upper side of the fabric. Another possibility has been to use additional retaining needles and to provide them at certain points across the width of the fabric, using them to anchor the effect thread by means of these needles.

Both possibilities have certain disadvantages. The first-mentioned possibility will obviously result in a rather displeasing appearance of the underside of the fabric because the effect threads must always led to the selvedge and are then exposed at the underside, hanging more or less freely. In the second possibility the choice of locating the connecting positions, that is the locations where the needles would engage the effect threads, is very limited and furthermore there will be an additional raised region at these different points in the fabric, interrupting the even thickness of the fabric -- particularly disadvantageous if the fabric is a ribbon -- and providing an aesthetically displeasing appearance.

SUMMARY OF THE INVENTION

It is, accordingly, a general object of the present invention to overcome the disadvantages of the prior art.

A more particular object of the invention is to provide an improved method of inserting effect threads into woven fabrics which is not possessed of the aforementioned disadvantages.

A concomitant object of the invention is to provide such a method which makes it possible to vary the width over which the effect threads are visible, even at the side where the effect thread is to be anchored, that is the side opposite from where it is inserted without aesthetically displeasing thickening of the material or without having the underside of the material have a displeasing appearance.

An additional object of the invention is to provide an apparatus for carrying out the present invention.

In pursuance of the above objects, and of others which will become apparent hereafter, one feature of the invention resides in a method of weaving a fabric which, briefly stated, comprises the steps of opening a warp, inserting an effect thread into the open warp, retainingly engaging the inserted effect thread for preventing it from being pulled off the warp, closing the warp and releasing the inserted effect thread. It is not necessary that the effect thread be retained until the warp is closed; instead, it can be released actually before the warp is closed. This will be explained in more detail later.

Advantageously the retention of the effect thread takes place at least until the reed or beating-up means has engaged the effect thread or the next effect thread or weft thread has been inserted and beaten up. Advantageously the means for engaging the inserted effect thread will be moved in at least substantial parallelism with the beating-up edge of the fabric in such a manner that it passes through the loop formed by the effect thread on insertion of the latter, so that when the device which inserts the effect thread is withdrawn the loop will pass around and tighten against the holding element. When the latter is then withdrawn it leaves behind a loop at the exposed surface of the fabric. In the event that this is not adequately retained and anchored, by the clamping effect of the change between warp opening and closing positions, by the beating-up or by subsequently inserting weft threads, then it can be anchored to or in the fabric in additional manner, by means of hot or cold adhesive, by welding (such as heat welding) or in other ways, for instance by thickening. Such thickening of the loop can for instance be achieved in that a drop of an a immediately solidifying mass (for example a synthetic plastic) is placed onto the loop.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 7 is an end view of FIG. 8, looking towards the left;

FIG. 8 is a side elevation of FIG. 7, looking towards the right;

FIG. 9 is a fragmentary perspective view, illustrating a further feature of the invention; and FIG. 10 is a view similar to FIG. 9, but showing still another feature of the invention.

DESCRIPTION OF THE PREFERRED EMBODIMENTS

Figure 1:
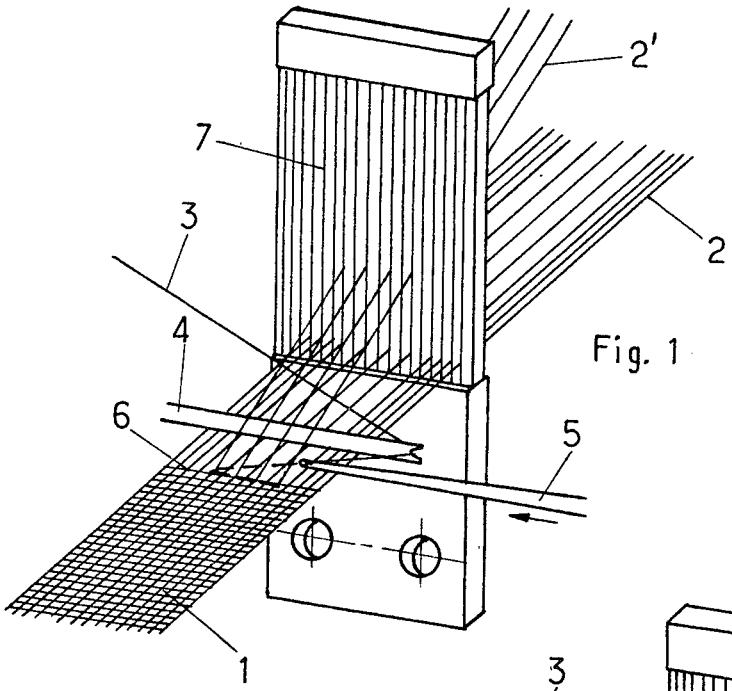
FIG. 1 is a somewhat diagrammatic illustration showing the warp open and the inserted effect thread being engaged by a holding element.

Discussing now the drawing in detail it will be seen that FIGS. 1–3 and 4 show three different operational stages of effect-thread insertion. In these Figures, reference numeral 1 identifies the fabric composed of the elongated warp 2 and the inserted weft threads, into which the effect weft thread (or threads) 3 is to be inserted. After a certain number of weft threads has been inserted transversely of the elongation of the warp 2, those warp threads 2′ are raised to the illustrated position in FIG. 1 across whose width the effect weft thread 3 is to be visible on the finished fabric (compare FIG. 3). The effect weft thread 3 is then inserted by an inserting element, here illustrated as a needle 4 which has a recessed leading end portion as shown, being inserted into the shed formed between the raised warp threads 2′ and the remaining non-raised threads of the warp 2.

When the element 4 has been inserted to the maximum extent as shown in FIG. 1, thereby forming a loop in the effect thread 3, an engaging and retaining element 5 enters from the opposite side of the warp 2 and moves into the loop. In this embodiment the element 5 is a form of a slightly forwardly conically tapering wire. It is pointed out that of course the directions of insertion of the effect thread 3 and of the element 5 could be reversed within the concept of the present invention.

Before proceeding with a description of FIGS. 1–3 and 4, a discussion of FIGS. 5 and 6–8 is necessary to facilitate an understanding of the invention.

Figure 5A:
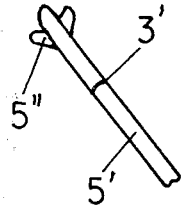
FIG. 5*a* is a fragmentary top-plan view, showing the inserting element provided with thread cutters.
Figure 6:
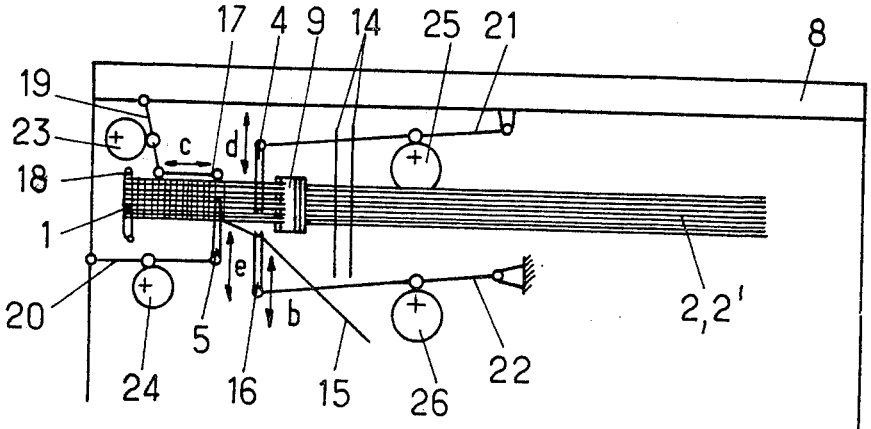
FIG. 6 is a partial top-plan view of FIG. 5.
Figure 5:
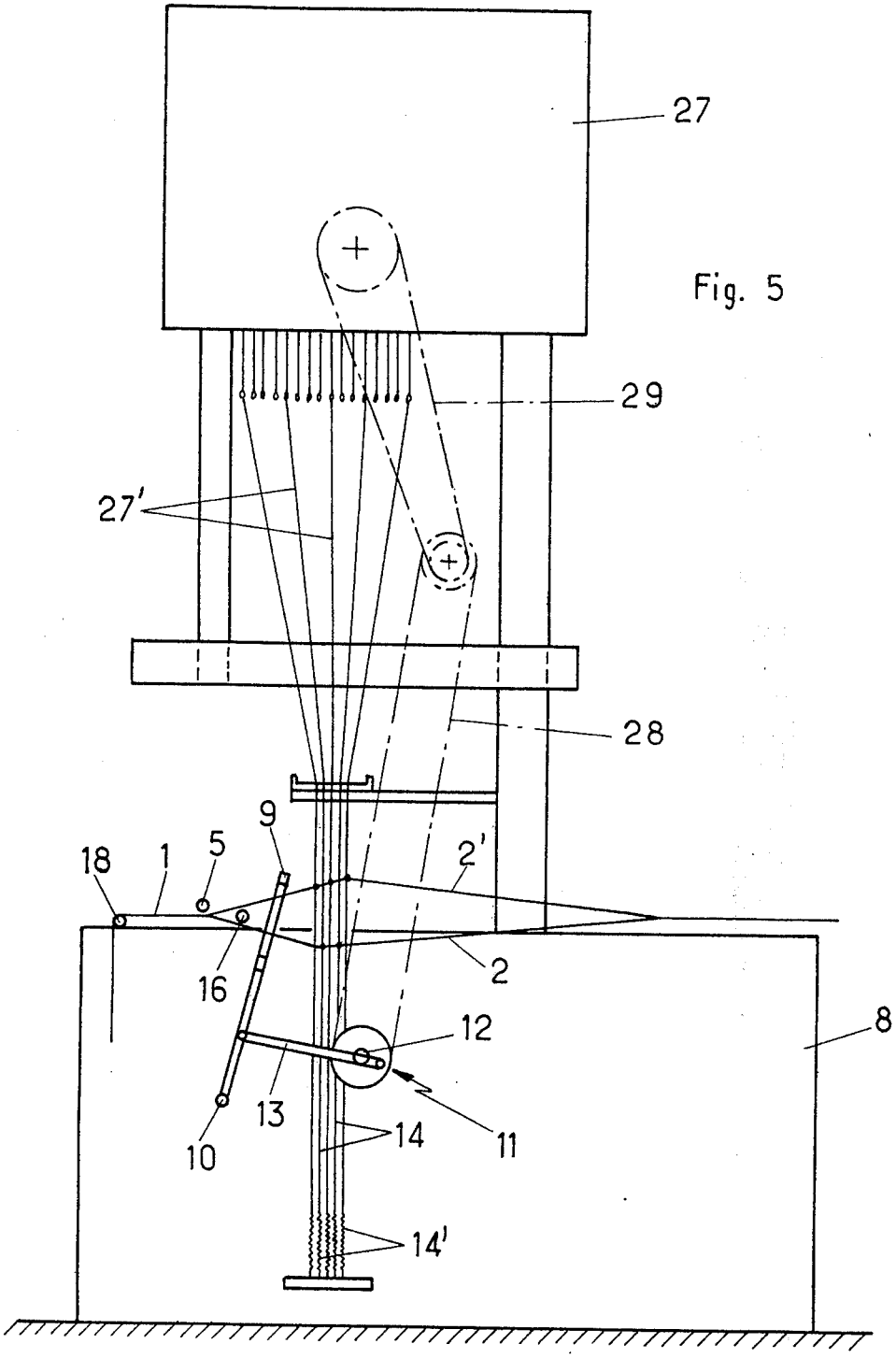
FIG. 5 is a diagrammatic vertical section of an apparatus according to the present invention.

FIGS. 5 and 6 show in more detail a loom which is provided with the novel arrangement according to the invention. The loom frame is identified with reference numeral 8, and the sley with numeral 9. The sley 9 is mounted on the shaft 10 and driven via connecting rods 13 by a crank drive 11 which turns about the main shaft 12. The opening and closing of the warp 2, 2′ is effected by five shafts 14 which are urged downwardly (in FIG. 5) by springs 14′ and are operated to move in the direction indicated by the double-headed arrow *a*, by the conventional and well-known apparatus 27 which is driven from the main shaft 12 via belts or chains 28, 29.

The weft threads 15 are for instance inserted by needle-like inserting elements 16, and the weft threads 15 are bound by a binding needle 17, for instance a latch needle. The element 16 moves in the direction of the double headed arrow *b* and the needle 17 in the direction of the double-hadded arrow *c*. The movement of the element 16 is so controlled that it is not simultaneously inserted into the warp 2, 2′ with the insertion of the element 4 for the effect thread 3, which element 4 moves in the direction of the double-headed arrow *d*.

The movement of the element 5 in the direction of the double-headed arrow *e* is coordinated with that of the element 4 and the finished fabric 1 is deflected downwardly about the breast beam 18 where it is withdrawn by a take-up.

Control of the elements 4 and 16, the element 5 and the needle 17 is effected in a manner known per se, for instance via linkages 19, 20, 21, 22 by means of suitable eccentrics 23, 24, 25 and 26.

The element 5 moves in at least substantial parallelism with the beating-up edge of the weft threads and effect thread, and moves above the plane of the warp 2 to approximately the opposite lateral edge thereof. Thereupon the element 4 is withdrawn so that the loop of the effect thread 3 is tightened about the element 5, being prevented from withdrawal out of the warp by the element 5. After the warp has been closed the reed or beating-up device 7 can now beat up the newly-inserted effect thread 3 against the preceding weft threads and/or effect threads, forming a new beat-up edge 6. This clamps the newly inserted effect thread 3 in the fabric whereupon the element 5 is withdrawn from the loop and is then in readiness for the next effect thread insertion, as shown in FIG. 3, which can take place either at once or after some further weft threads have first been inserted.

The small loops 3′ remaining at the upper side of the fabric may be permitted to remain for further effect. They can, however, also be served or, to anchor them more firmly to the fabric, they may be adhesively bonded or welded thereto, or thickened (e.g. by application of a drop of hardenable resin material to the respective loop).

Figure 3:
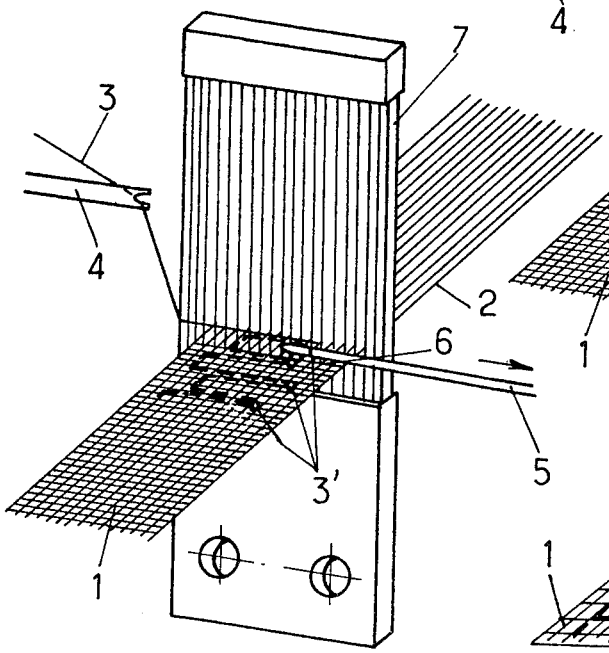
FIG. 3 shows, in a view similar to FIGS. 1 and 2, a further stage of the operation.
Figure 2:
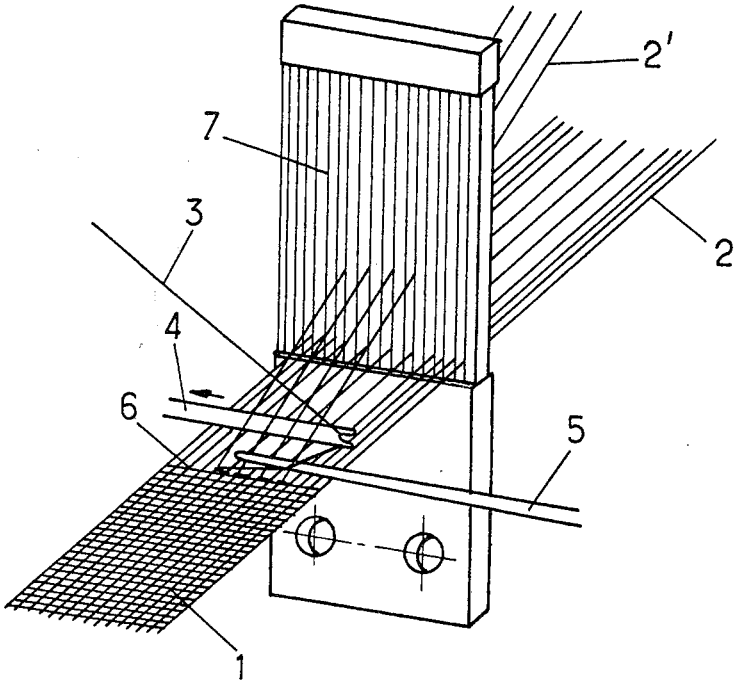
FIG. 2 is a view similar to FIG. 1 showing the inserting element for the effect thread withdrawn and the warp closed.

The width of the various effect threads 3 can differ, as evident from FIGS. 1–3. In other words, one effect thread may be exposed at the upper fabric side for a short distance, and the next one for a longer distance, or vice versa. This is governed only by the width of the space between the laterally outermost ones of the raised warp threads 2′. No adjustment to the structure or movements of the elements 4 or 5 is necessary, nor to the means controlling their operation. To repeat: To effect such variation it is not necessary to change the length or direction of movement either of the elements 4 or 5, because the variation effect is determined exclusively by the number and arrangement of raised warp threads 2′.

In FIGS. 1–3 no attempt has been made to show the devices for inserting the weft threads or other components, in order to avoid confusion and to facilitate an understanding of the invention.

Details of how the movement of element 5 is controlled, are shown in FIGS. 7 and 8. The element 5 is reciprocated in direction of the double-headed arrow *e* by the arm 20, which receives motion from the eccentric 24 (see FIG. 6). In addition, the element 5 performs a part-circular movement which is indicated by the double-headed arrow *f* in FIG. 7. To make this possible, the element 5 is not directly connected with the arm 20; instead, it is secured to a ring 30 which in turn is connected with arm 20 via a bearing 31. The ring 30 slidably surrounds a rod 32 which is fixedly mounted on the loom frame (e.g. in the region of its right-hand end which is not visible in FIG. 8). At its free end (i.e. the left-hand end in FIG. 8), the rod 32 is provided with an abutment 33. A helical expansion spring 34 surrounds the rod and bears upon the abutment 33 and the ring 30, respectively. The latter is provided with a guide projection 36 which extends into a groove 35 formed in and extending longitudinally of the rod 32. In the region where it approaches the abutment 33, the groove 35 has a portion 35′ which twists helically about the rod and which merges into a substantially straight end portion 35″ extending towards the abutment 33.

When the element 5 assumes the position shown in FIG. 8, (i.e., the twelve o'clock position shown in FIG. 7) its left-hand free end is withdrawn from the warp thread. If, now, the arm 20 is shifted towards the left in FIG. 8, it displaces the element 5 in the same direction, via bearing 31 and ring 30. This movement of element 5 is initially a straight-line movement, as long as the projection 36 sliding in the groove 35 has not reached the portion 35′ thereof. During this part of its movement the element 5 can advance freely above the plane of the warp 2.

Just before the projection 36 enters the groove portion 35′, the element 5 is in the position shown in FIG. 1 in which its free end has passed the effect weft thread 3, so that the latter is in contact with the element 5.

During further leftward movement of element 5 (in FIG. 8), the projection enters the groove portion 35′. This causes the ring 30, and with it the element 5, to turn first in counterclockwise direction (see arrow *f* in FIG. 7) in order to clear the raised warp threads 2′ and then to advance slightly further towards the left as the projection 36 slides in the groove portion 35″, until ring 30 contacts abutment 30 and element 5 is in the ten o'clock position shown in FIG. 7. At this time (see FIG. 2), element 5 is in contact with the upper side of the warp 2 adjacent the beating-up edge 6 and forms in the effect weft thread 3 the loop 3′, aided by the right-hand raised weft thread 2′ which tends to push the loop further onto element 5 during the final advancement of the same along groove portion 35″.

The element 5 remains in this position until the needle 4 is retracted. At this time, the warp shed is closed and the arm 20 moves in the opposite direction, causing the element 5 to start its retracting movement towards the starting position (see FIG. 3). This retracting movement is aided by the biasing force of spring 34. At this time, also, the beating-up device 7 begins to approach the beating-up edge 6. The projection 36 is still sliding in the groove portion 35″.

Figure 4:
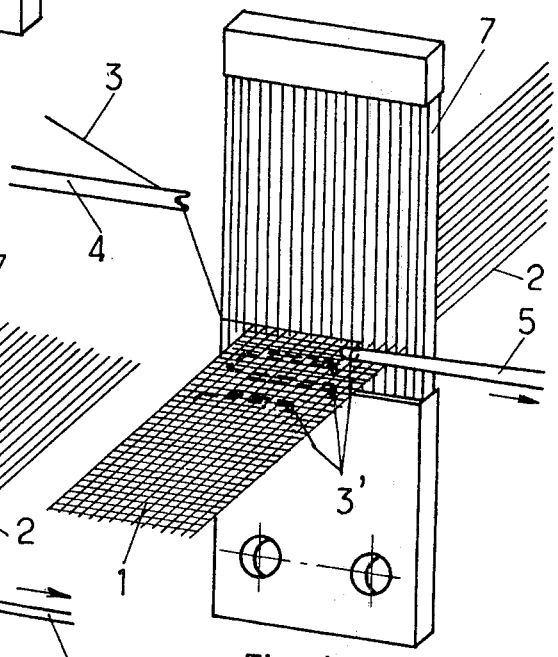
FIG. 4 is a view similar to FIG. 3, showing the inserting element ready for withdrawal from the closed warp.
Figure 3A:
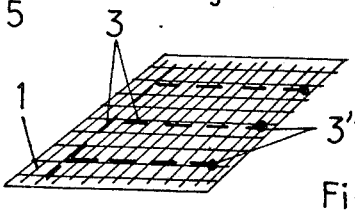
FIG. 3*a* is a fragmentary plan view, showing how the loops of the effect thread can be vised.

FIG. 4 shows the effect warp thread 3 in fully beaten-up condition. The free end of element 5 has not yet cleared the loop 3′, but the projection 36 has passed through the groove portion 35′ into the groove 35. During its further movement in groove 35 to the starting position of FIG. 8, the element 5 will move out of loop 3′ and the latter will be retained in place due to the closing of the warp sled. The next loop-forming sequence can now begin.

FIG. 5*a* shows that the element 5 can be provided adjacent its free end with one or more thread cutters 5″, if it is decided to sever the loops rather than have them intact. These cutters 5″ will then cut the thread forming the loop, as the element is retracted from the position shown in FIG. 4.

If it is desired to fix the loops 3′ positively, then a device such as that shown in FIG. 9 may be provided. In this embodiment, a receptacle 38 containing an adhesive 37 is mounted above the fabric 1. A rotary roller 39 is provided which receives a layer of adhesive 37 on its periphery from the receptacle 38. The roller 39 may be driven and is so positioned above the fabric 1 that as the latter moves beneath it, only the upstanding loops 3′ come in contact with the adhesive on the roller periphery, so that each loop 3′ receives a drop 3″ of the adhesive. These drops then become bonded to the fabric 1 and positively secure the loops 3′.

Another possibility for positive fixing of the loops 3′ is shown in FIG. 10. This embodiment can be used when at least the effect weft thread 3 is of a thermoplastic synthetic material. It involves the provision of a resistance wire to which is arranged above the fabric 1 at such a distance that the heat emanating from the energized wire will melt the material of the loops 3′, causing the molten material to bond with the fabric 1 or resolidification, whereby again the connecting points or spots 3″ are formed.

Of course, modifications of the illustrated embodiment will offer themselves to those skilled in the art. Thus, the element 4 may instead of the recessed illustrated leading end be provided with an eye or hook.

It is also possible to provide a separate element which takes over the thread 3 from the element 4 and places it about the element 5. Such a separate element makes it unnecessary to move the element 5 not only transversely of the warp but additionally in the direction of elongation of the warp or in other directions inclined to the plane of the warp.

The present invention makes it possible to provide effect threads in fabrics which are woven even on needle looms, and which can be inserted from any desired side of the fabric to any desired point of the fabric, that is part-way or all the way across the width of the latter, without requiring separate controls for the different widths desired for the effect thread, that is without having to have separate controls for controlling different movements of the elements 4 and 5 in dependence upon the width for which the effect thread is to be provided. By using the element 5, it is assured that the loops 3′ will automatically be formed about the element 5 and located at the desired position, that is they will always form at the first warp thread in the upper part of the shed and they will always be of the same size. The quantity of effect thread used is limited exactly to the visible width of the effect thread in the fabric, meaning that no portions of the effect thread remain at the underside of the fabric where they can hange loose and provide an aesthetically pleasing pppearance, and also no thickening or other imperfections in the fabric will result.

It will be understood that each of the elements described above, or two or more together, may also find a useful application in other types of applications differing from the types described above.

While the invention has been illustrated and described as embodied in the insertion of an effect thread, it is not intended to be limited to the details shown, since various modifications and structural changes may be made without departing in any way from the spirit of the present invention.

Without further analysis, the foregoing will so fully reveal the gist of the present invention that others can by applying current knowledge areadily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a method of weaving a fabric on a needle loom using a main weft thread being inserted from either side of the warp and an effect weft thread being inserted from one side of the warp, the steps of forming a shed intermediate the width of the warp and spaced from the edges thereof; moving an effect weft thread from one side into the open shed so as to form a loop laterally adjacent the opposite side of the open shed above the remaining edge warp; moving a retaining member transversely and longitudinally of said warp from said opposite side and at a location which is spaced lengthwise of the warp from said loop until it enters said loop to retain the same from being pulled out from said shed; closing said shed; and withdrawing said retaining member from said loop.

2. A method as defined in claim 1, wherein the step of withdrawing is carried out prior to the step of closing.

3. A method as defined in claim 1; and further comprising the step of severing said loop subsequent to the step of closing.

4. A method as defined in claim 1; and further comprising the step of adhesively fixing said loop to said fabric.

5. A method as defined in claim 1; and further comprising the step of adhesively fixing said loop to said fabric.

6. In a needle loom for weaving a fabric wherein a main weft thread is inserted from either side of the warp and an effect weft thread is inserted from one side of the warp, a combination comprising first means for forming said warp; second means for opening and closing a shed intermediate the width of said warp and spaced from the edges thereof; third means for moving said effect weft thread from one side into the open shed so as to form a loop laterally adjacent the opposite side of the open shed above the remaining edge warp; and fourth means, including a retaining member movable transversely and longitudinally of said warp from said opposite side and at a location which is spaced lengthwise of the warp from said loop until it enters said loop to retain the same from being out from said shed while the latter is being closed.

7. A combination as defined in claim 6; further comprising beating-up means for said main and effect weft threads which have been inserted into said warp; and wherein said retaining member is located ahead of said beating-up means.

8. A combination as defined in claim 6, wherein said retaining member is needle shaped.

9. A combination as defined in claim 8, wherein said retaining member has a free end portion and tapers conically in direction towards said free end portion.

10. A combination as defined in claim 6, wherein said fourth means comprises control means for imparting said transverse and longitudinal movement to said retaining member.

11. A combination as defined in claim 6, wherein said fourth means comprises control means for subsequently withdrawing said retaining member from said loop.

* * * * *